US006902379B2

(12) United States Patent
Takai

(10) Patent No.: US 6,902,379 B2
(45) Date of Patent: Jun. 7, 2005

(54) DISPLACEMENT CONTROL VALVE OF VARIABLE DISPLACEMENT COMPRESSOR, COMPRESSORS INCLUDING SUCH VALVES, AND METHODS FOR MANUFACTURING SUCH COMPRESSORS

(75) Inventor: Kazuhiko Takai, Isesaki (JP)

(73) Assignee: Sanden Corporation, Gunma (JP)

( * ) Notice: Subject to any disclaimer, the term of this patent is extended or adjusted under 35 U.S.C. 154(b) by 260 days.

(21) Appl. No.: 10/404,106

(22) Filed: Apr. 2, 2003

(65) Prior Publication Data

US 2003/0190238 A1 Oct. 9, 2003

(30) Foreign Application Priority Data

Apr. 9, 2002 (JP) ..... 2002-106462

(51) Int. Cl.[7] ..... F04B 1/26
(52) U.S. Cl. ..... 417/222.2; 251/255
(58) Field of Search ..... 417/222.2; 251/129.15, 251/129.07, 255; 335/262

(56) References Cited

U.S. PATENT DOCUMENTS

| | | | | |
|---|---|---|---|---|
| 4,780,060 | A | 10/1988 | Terauchi | |
| 4,874,295 | A | 10/1989 | Kobayashi et al. | |
| 4,878,817 | A | 11/1989 | Kikuchi et al. | |
| 4,960,367 | A | 10/1990 | Terauchi | |
| 6,074,173 | A | 6/2000 | Taguchi | |
| 6,099,276 | A | 8/2000 | Taguchi | |
| 6,102,670 | A | 8/2000 | Taguchi | |
| 6,129,519 | A | 10/2000 | Ogura | |
| 6,179,572 | B1 | 1/2001 | Taguchi | |
| 6,196,808 | B1 | 3/2001 | Taguchi | |
| 6,257,848 | B1 | 7/2001 | Terauchi | |
| 6,443,707 | B1 * | 9/2002 | Kimura et al. | 417/222.2 |
| 6,520,751 | B2 | 2/2003 | Fujita et al. | |
| 6,540,488 | B2 | 4/2003 | Takai et al. | |
| 6,710,786 | B1 * | 3/2004 | Jacobs et al. | 715/744 |
| 2002/0182087 | A1 * | 12/2002 | Okii et al. | 417/222.2 |

* cited by examiner

*Primary Examiner*—Charles G Freay
(74) *Attorney, Agent, or Firm*—Baker Botts L.L.P.

(57) ABSTRACT

A variable displacement compressor and a displacement control valve for use in such compressors, varies the displacement of the compressor by closing or opening a control path between a discharge chamber or a suction chamber and a crank chamber. The valve includes a valve body for closing or opening the control path; a control rod; and a rod passage receiving the control rod. A first end of the control rod is affixed to the valve body, and the control rod extends from the valve body to a solenoid for urging the valve body to close or open the control path. The control rod is tapered, such that a first cross-sectional area of the control rod proximate to the valve body is greater than a second cross-sectional area of the control rod proximate to the solenoid to close or open the control path. A method for manufacturing such compressors includes the steps of providing a displacement control valve, wherein the valve comprises a valve body, a control rod, a rod passage receiving the control rod, wherein a first end of the control rod is affixed to the valve body and the control rod extends from the valve body to the solenoid for urging the valve body to close or open the control path; and tapering the control rod. The rod is tapered, such that a first cross-sectional area of the control rod proximate to the valve body is greater than a second cross-sectional area of the control rod proximate to the solenoid for urging the valve body to close or open the control path.

24 Claims, 5 Drawing Sheets

DISPLACEMENT CONTROL VALVE OF VARIABLE DISPLACEMENT COMPRESSOR, COMPRESSORS INCLUDING SUCH VALVES, AND METHODS FOR MANUFACTURING SUCH COMPRESSORS

BACKGROUND OF THE INVENTION

1. Field of the Invention

The present invention relates to a displacement control valve of a variable displacement compressor, which is suitable for use in an automobile air conditioning system and the like, and more specifically, to an improved mechanism of the displacement control valve which maintains a smooth operation. Moreover, the invention relates to compressors comprising such control valves.

2. Description of Related Art

Variable displacement compressors provided in a refrigerant circuits for automobile air conditioning systems, for example, the variable displacement compressor disclosed in Japanese Patent No. JP-A-2000-18172 are known. As depicted in FIG. 3, this variable displacement compressor 50 has a cylinder block 51 with a plurality of cylinder bores 51*a*, a front housing 52 provided on one end of cylinder block 51, and a rear housing 53 provided on the other end of cylinder block 51 via a valve plate 54. A drive shaft 56 is provided across a crank chamber 55 which is formed by cylinder block 51 and front housing 52. An inclined plate 57 is disposed around drive shaft 56. A rotor 58 is fixed on drive shaft 56, and inclined plate 57 is connected to rotor 58 via a joint portion 59.

One end of drive shaft 56 extends up to the outside of front housing 52 through the interior of a boss portion 52*a* which protrude from front housing 52. An electromagnetic clutch 70 is provided around boss portion 52*a* via a bearing 60. Electromagnetic clutch 70 comprises a rotor 71 provided around boss portion 52*a*, an electromagnet 72 contained in rotor 71, and a clutch plate 73 provided on an end surface of rotor 71. Clutch plate 73 is connected to one end of drive shaft 56 via a fastener 74, such as a bolt. A seal member 52*b* is interposed between drive shaft 56 and boss portion 52*a*, and the inside and the outside of the compressor are sealed from each other. The other end of drive shaft 56 is present in cylinder block 51, and the other end is supported by a supporting member 78. Bearings 75 and 77 are provided around drive shaft 56, and a bearing 76 is provided on an end surface of rotor 58.

A piston 62 is inserted slidably into each cylinder bore 51*a*. The radially outer portion of inclined plate 57 is received in a concave portion 62*a* which is formed on the inner end portion of piston 62. The radially outer portion of inclined plate 57 slidably engages a pair of shoes 63, so that the rotational movement of inclined plate 57 is transformed into the reciprocating movement of piston 62.

A suction chamber 65 and a discharge chamber 64 are defined in rear housing 53 separately from each other. Suction chamber 65 communicates with cylinder bore 51*a* via a suction port 81, which is provided on valve plate 54, and via a suction valve (not shown). Discharge chamber 64 can communicate with cylinder bore 51*a* via a discharge port 82, which is provided on valve plate 54, and via a discharge valve (not shown). Suction chamber 65 communicates with crank chamber 55 via an orifice 83, which is opened on valve plate 54, and via a refrigerant chamber 84, which is formed at a position on the end surface of drive shaft 56.

A displacement control valve 10 is provided in a concave portion which is formed on the rear wall of rear housing 53 of this variable displacement compressor 50. As depicted in FIG. 4, displacement control valve 10 is provided in a control mechanism equity 53*a* which is formed within the end portion of rear housing 53. Displacement control valve 10 has a valve casing 1 with a valve casing body 1*a* and a cap 1*b* provided on the end of the valve casing body 1*a*. A bellows 2 is disposed as a pressure sensing means in a pressure sensing chamber formed at an end portion in valve casing 1. Bellows 2 comprises a bellows body 2*b*, shaft members 2*d* which project from the respective inner ends of bellows body 2*b* and the tips of which are disposed separately from each other, an inner spring 2*a* disposed around shaft members 2*d* in bellows body 2*b*, and a support member 2*c* provided on and contiguous with the end of bellows body 2*b*. The inside of bellows body 2*b* is set substantially in a vacuum condition. A spring 3 is disposed around support member 2*c* to urge bellows body 2*b* toward an end surface of cap 1*b* via shaft members 2*d*. Bellows 2 functions as a pressure sensing means for detecting a pressure in suction chamber 65 (hereinafter, "a suction pressure").

A rod passage 1*c* is provided in valve casing body 1*a* and extends through valve casing body 1*a* in the axial direction of displacement control valve 10. A pressure sensitive rod 4 is inserted into rod passage 1*c* within valve casing body 1*a* and supported by valve casing body 1*a*. One end of pressure sensitive rod 4 contacts the upper end of support member 2*c* of bellows 2, and the other end of pressure sensitive rod 4 contacts a valve body 5*a* which is formed as a large-diameter part on one end of a valve mechanism 5. Because bellows 2 is a pressure sensing means, and because pressure sensitive rod 4 is connected operatively to bellows 2, valve body 5*a* opens or closes communication paths 66, 1*g*, 1*d*, 1*e*, and 68 between discharge chamber 64 and crank chamber 55 in accordance with the expansion or contraction of bellows 2. A fixed core 7 with a rod guide passage 7*a* is disposed around valve mechanism 5. The lower end of core 7 contacts the upper end of valve casing body 1*a*. Core 7 slidably supports a valve shaft 5*b* of valve body 5*a* (hereinafter, "a solenoid rod"). Valve casing body 1*a* and a first end of fixed core 7 form a valve chamber 6. Specifically, one end portion of valve mechanism 5 is received in valve chamber 6.

Valve chamber 6 communicates with discharge chamber 64 via communication path 68, chamber 14, and communication path 1*e*. A plunger 9 is provided on a second end of fixed core 7. A tube 8 covers plunger 9 and a part of fixed core 7. A plunger chamber 11 is defined by fixed core 7 and tube 8. A communication path 13 communicates between plunger chamber 11 and suction chamber 65 via communication path 67, orifices 1*f*, and pressure sensing space 15. A solenoid 12 formed by an electromagnetic coil is disposed around tube 8. Solenoid 12 creates a magnetic field for applying an electromagnetic force on a gap between plunger 9 and fixed core 7 and applying the electromagnetic force to valve body 5*a* via solenoid rod 5*b*.

In such a displacement control valve 10, the displacement is changed by adjusting the opening degree of the control path which connects the discharge chamber and the crank chamber.

In the above-described mechanism of displacement control valve 10, the gaps between rods 4 and 5*b* slidably inserted and rod passages 1*c* and 7*a*, respectively, are designed with close clearances to suppress refrigerant leakage. However, a shift may occur between the axes of rods 4 and 5*b* and the axes of rod passages 1*c* and 7*a* by a finishing error or an assembly error. In particular, as depicted in FIG. 5, in a case in which there is a shift in angle between the axes, the orientation of gaps between rods 4 and 5*b* and rod passages 1*c* and 7*a* are offset from each other by 180 degrees between the entrance portions and the exit portions of rod passages 1*c* and 7*a*. In other words, the orientation having a maximum gap at the entrance portion becomes a orientation having a minimum gap at the exit portion. On the other hand, because rod passages 1*c* and 7*a* are provided in respective partition walls, both end parts partitioned by each partition wall experience a pressure difference, and a portion of refrigerant flows into the above-described clearance from the increased pressure side to the reduced pressure side. At that time, fine foreign materials contained in the refrigerant may enter into this clearance. If there is a shift between axes, the foreign materials having entered from the maximum gap direction into the clearance may not be discharged from the gap between the rod and the rod passage, depending on the size of the foreign materials. Further, the foreign materials may damage the movement of the rod by wedging within the clearance(s), and it may degrade operation of the control valve and may cause poor control on compressor displacement.

Such a situation may be better understood with reference to FIG. 5. With respect to solenoid rod 5*b*, a discharge pressure is operating in space 6, and on the other hand, a suction pressure is operating in plunger chamber 11 because chamber 11 communicates with suction chamber 65. Therefore, refrigerant flows from space 6 to plunger chamber 11 through the gap between solenoid rod 5*b* and rod passage 7*a*, and at that time, fine foreign materials may enter into the gap. As depicted in FIG. 5, in a case where the axis of solenoid rod 5*b* inclines relative to the axis of rod passage 7*a*, foreign materials having entered from the larger gap may be brought into a deep portion by the refrigerant flow. When solenoid rod 5*b* is inclined, the gap may decrease in size gradually, and at last, the foreign materials having entered may be pressed between solenoid rod 5*b* and rod passage 7*a*, thereby damaging the movement of solenoid rod 5*b*. In addition, with respect to the pressure sensitive rod 4 side, because a pressure in the crank chamber and a suction pressure operate on the upper and lower sides thereof, foreign materials may be drawn into the gap by the pressure difference. Consequently, foreign materials having a certain size may not be discharged and may be pressed within rod passage 1*c*, thereby damaging the movement of pressure sensitive rod 4.

SUMMARY OF THE INVENTION

Accordingly, a need has arisen to provide an improved structure for a displacement control valve of a variable displacement compressor and compressors comprising such valves, which is not subjected to a wedge created by the pressing of foreign materials into the components even if foreign materials enter into a gap between a rod and a rod guide passage, and further which may easily discharge the entered foreign materials from the gap, thereby maintaining a stable operation.

To satisfy the foregoing need and other needs, a displacement control valve of a variable displacement compressor according to the present invention is provided. In an embodiment of a displacement control valve for use in a variable displacement compressor, the displacement of the compressor is varied by closing or opening a control path between a discharge chamber or a suction chamber and a crank chamber. The valve comprises a valve body for closing or opening the control path; a control rod; and a rod passage receiving the control rod. A first end of the control rod is affixed to the valve body, and the control rod extends from the valve body to means for urging the valve body to close or open the control path. The control rod is tapered, such that a first cross-sectional area of the control rod proximate to the valve body is greater than a second cross-sectional area of the control rod proximate to the means for urging the valve body to close or open the control path.

In another embodiment, this invention is a variable displacement compressor comprises a displacement control valve, wherein the displacement of the compressor is varied by closing or opening a control path between a discharge chamber or a suction chamber and a crank chamber. The valve comprises a valve body for closing or opening the control path; a control rod; and a rod passage receiving the control rod. A first end of the control rod is affixed to the valve body, and the control rod extends from the valve body to means for urging the valve body to close or open the control path. The control rod is tapered, such that a first cross-sectional area of the control rod proximate to the valve body is greater than a second cross-sectional area of the control rod proximate to the means for urging the valve body to close or open the control path.

In still another embodiment, the invention is a displacement control valve for use in a variable displacement compressor, wherein the displacement of the compressor is varied by closing or opening a control path between a discharge chamber or a suction chamber and a crank chamber. The valve comprises a valve body for closing or opening the control path; a control rod; and a rod passage receiving the control rod. A first end of the control rod is affixed to the valve body, and the control rod extends from the valve body to means for urging the valve body to close or open the control path. The rod is tapered, such that a gap formed between the rod and the rod passage increases in size proximate to the means for urging the valve body.

In yet another embodiment, the invention is a variable displacement compressor comprising a displacement control valve, wherein the displacement of the compressor is varied by closing or opening a control path between a discharge chamber or a suction chamber and a crank chamber. The valve comprises a valve body for closing or opening the control path; a control rod; and a rod passage receiving the control rod. A first end of the control rod is affixed to the valve body, and the control rod extends from the valve body to means for urging the valve body to close or open the control path. The rod again is tapered, such that a gap formed between the rod and the rod passage increases in size proximate to the means for urging the valve body.

In still yet another embodiment, the invention is a displacement control valve for use in a variable displacement compressor, wherein the displacement of the compressor is varied by closing or opening a control path between a discharge chamber or a suction chamber and a crank chamber. The valve comprises a valve body for closing or opening the control path; a control rod; and a rod passage receiving the control rod. A first end of the control rod is affixed to the valve body, and the control rod extends from the valve body to means for urging the valve body to close or open the control path. A spiral groove is formed about, within, and over at least a portion of a peripheral surface of at least one of the rod and of the rod passage.

In a further embodiment, the invention is a variable displacement compressor comprising a displacement control valve, wherein the displacement of the compressor is varied by closing or opening a control path between a discharge chamber or a suction chamber and a crank chamber. The valve comprises a valve body for closing or opening the control path; a control rod; and a rod passage receiving the control rod. A first end of the control rod is affixed to the valve body, and the control rod extends from the valve body to means for urging the valve body to close or open the control path. A spiral groove is formed about, within, and over at least a portion of a peripheral surface of at least one of the rod and of the rod passage.

In still a further embodiment, the invention is a variable displacement compressor comprising a displacement control valve, wherein the displacement of the compressor is varied by closing or opening a control path between a discharge chamber or a suction chamber and a crank chamber. The valve comprises a valve body for closing or opening the control path; a control rod; and a rod passage receiving the control rod. A first end of the control rod is affixed to the valve body, and the control rod extends from the valve body to means for urging the valve body to close or open the control path. A spiral groove is formed about, within, and over at least a portion of a peripheral surface of the rod.

In still an further embodiment, the invention is a method for manufacturing a variable displacement compressor. This method comprises the steps of providing a displacement control valve, wherein the valve comprises a valve body for closing or opening a control path, a control rod, a rod passage receiving the control rod, wherein a first end of the control rod is affixed to the valve body and the control rod extends from the valve body to means for urging the valve body to close or open the control path; and tapering the control rod, such that a first cross-sectional area of the control rod proximate to the valve body is greater than a second cross-sectional area of the control rod proximate to the means for urging the valve body to close or open the control path.

In yet a further embodiment, the invention is a method for manufacturing a variable displacement compressor. This method comprises the steps of providing a displacement control valve, wherein the valve comprises a valve body for closing or opening a control path, a control rod, a rod passage receiving the control rod, wherein a first end of the control rod is affixed to the valve body and the control rod extends from the valve body to means for urging the valve body to close or open the control path; and tapering the control rod, such that a gap formed between the rod and the rod passage increases in size proximate to the means for urging the valve body.

In still yet a further embodiment, the invention is a method for manufacturing a variable displacement compressor. The method comprises the steps of providing a displacement control valve, wherein the valve comprises a valve body for closing or opening a control path, a control rod, a rod passage receiving the control rod, wherein a first end of the control rod is affixed to the valve body and the control rod extends from the valve body to means for urging the valve body to close or open the control path; and forming a spiral groove is formed about, within, and over at least a portion of a peripheral surface of at least one of the rod and of the rod passage.

In the displacement control valves described above, the gap between an outer peripheral surface of the rod and an inner circumferential surface of the rod passage is formed, so that the gap becomes larger in a low-pressure side or crank case chamber-side than in a high-pressure side over at least a portion of the rod in a radial direction. As the refrigerant flows from the high-pressure side toward the low-pressure side, even if there is a shift between the axis of the rod (e.g., the radial direction) to the axis of the rod passage due to an error in the finishing of valve parts or an error in the assembly of the valve parts, the gap between the rod and the rod passage does not decrease. Moreover, foreign materials, which may enter into this gap, may be easily discharged from the gap. Alternatively, even in a case in which such foreign materials are not discharged, the rod does not become wedged into the rod passage, and the movement of the rod may not be damaged. Therefore, smooth operation of the rod within the rod passage may be stably maintained.

Further, in compressors or valves in which a spiral groove extends within and over at least a portion of an outer peripheral surface of the rod or of an inner circumferential surface of the rod passage, or both, in a substantially radial direction, the path of fine foreign materials entering from the high-pressure side into the low-pressure side inevitably crosses the spiral groove. Thus, the foreign materials accompanying the refrigerant flow may be captured within the spiral groove. Fine foreign materials captured within the spiral groove may be readily discharged by the refrigerant flowing in the spiral groove in the direction of the spiral groove. Alternatively, even in the situation in which foreign materials are not discharged, this configuration avoids the wedging of the rod within the rod passage, and the movement of the rod may not be damaged. Therefore, smooth operation of the rod within the rod passage may be stably maintained.

Thus, in the present invention, the displacement control valve may operate without being damaged by foreign materials, and stable operation of the displacement control valve may be maintained. Therefore, improper operation of the displacement control valve, due to the presence of foreign materials in the compressor or in a system using the compressor or due to foreign materials generated during driving, may be avoided or reduced, and displacement control may be stably achieved.

Other objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
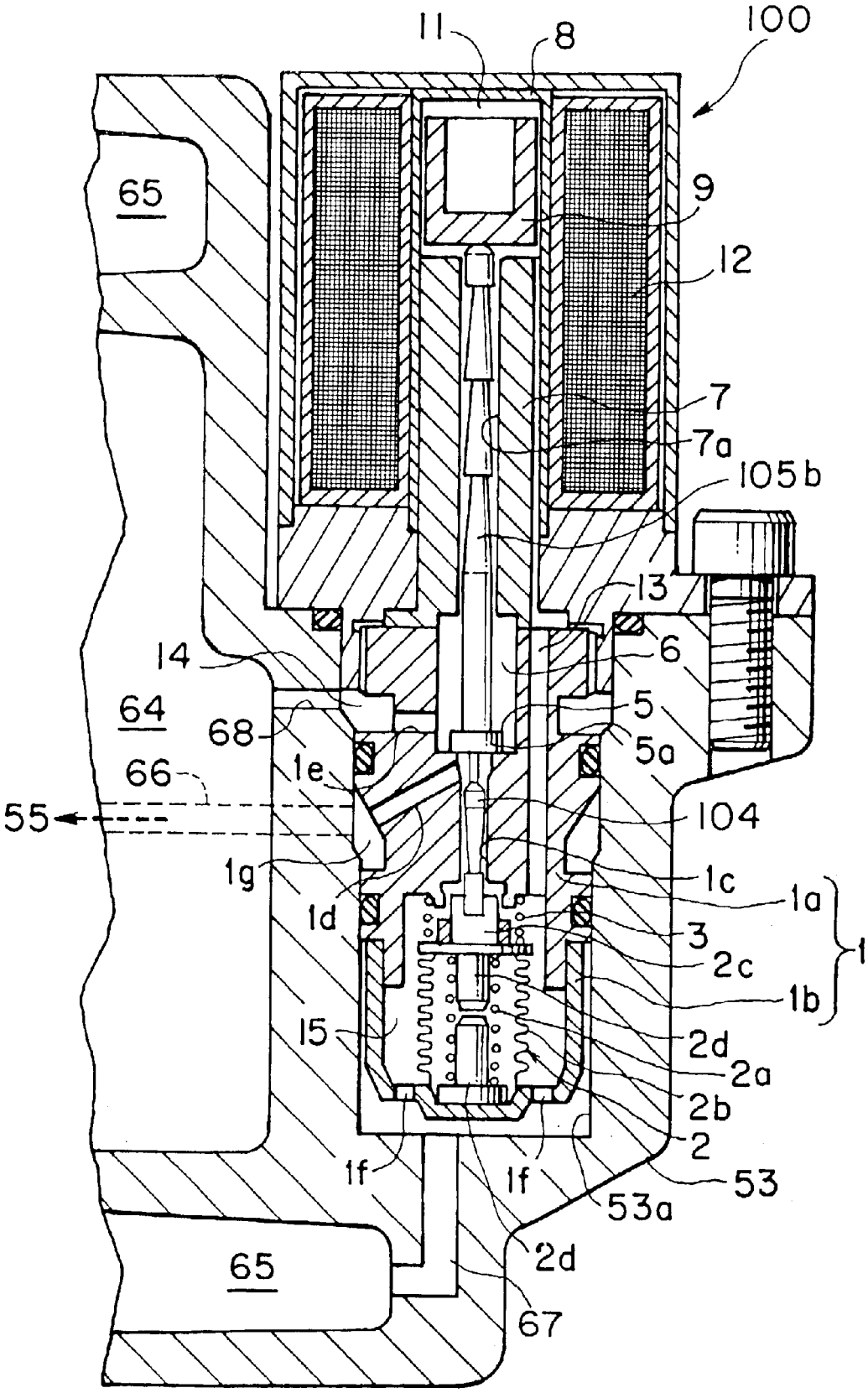
FIG. 1 is a cross-sectional view of a displacement control valve of a variable displacement compressor according to an embodiment of the present invention.
Figure 3:
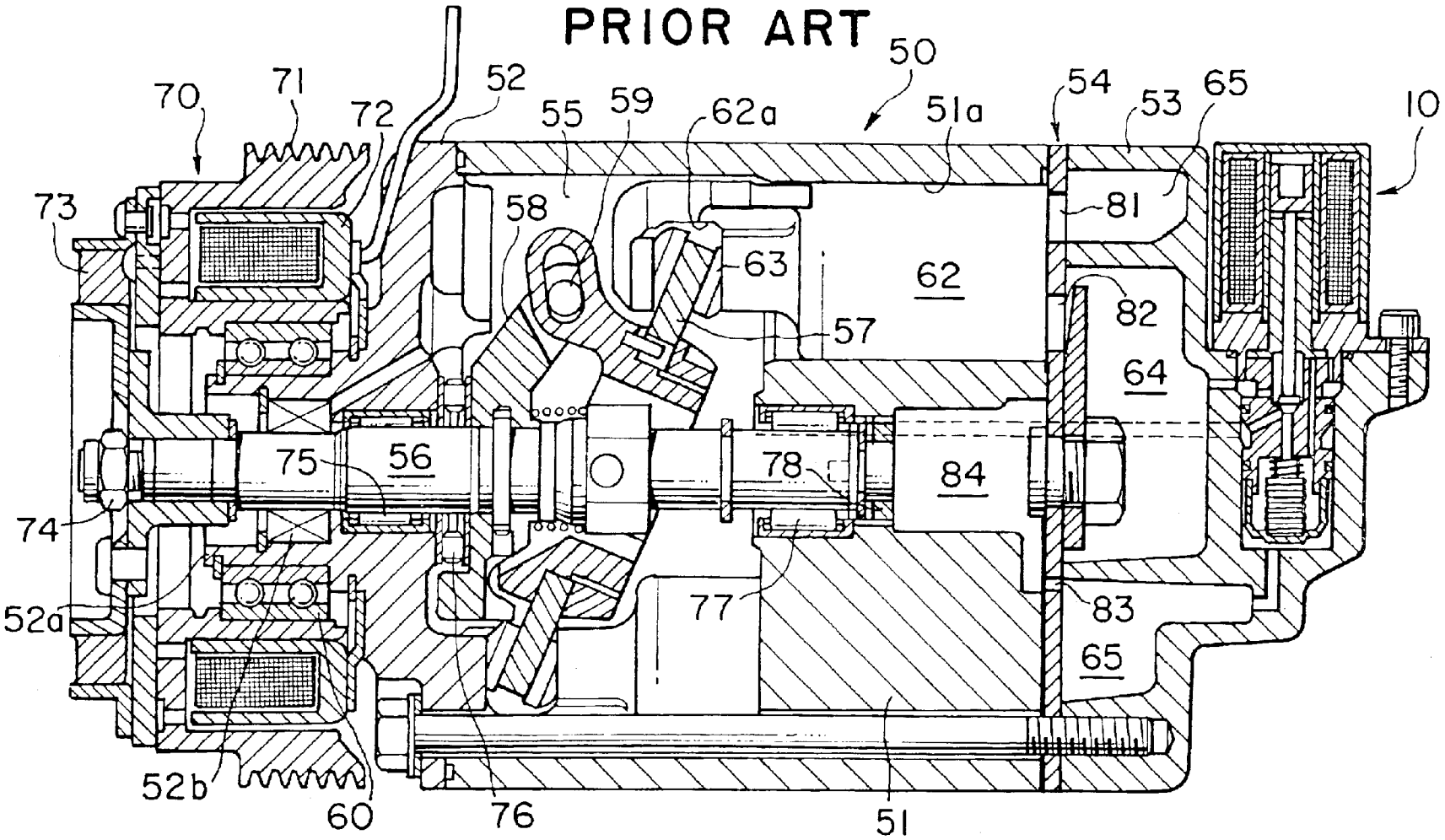
FIG. 3 PRIOR ART
FIG. 3 is a cross-sectional view of a known variable displacement compressor.

In the present invention, because portions of a variable displacement compressor, other than the displacement control valve, are substantially the same as those depicted in FIG. 3, only the displacement control valve is described in detail. FIG. 1 depicts a displacement control valve of a variable displacement compressor according to an embodiment of the present invention. In this embodiment, as compared with the structure depicted in FIGS. 4 and 5, the structures of a solenoid rod 105*b* and a pressure sensitive rod 104 of a displacement control valve 100 are different. Because the structures of other portions are substantially the same as those depicted in FIGS. 4 and 5 and described previously, explanation for those other portions is omitted here and similar elements are assigned like numbers.

In FIG. 1, solenoid rod 105*b*, which is inserted into rod passage 7*a* of fixed core 7 is formed to include a plurality of tapered portions. This configuration may be especially effective when the rod is relatively long. The diameter of each portion becomes gradually smaller from a high-pressure side (e.g., the side of chamber 6) toward a low-pressure side (e.g., the side of plunger chamber 11) in the radial direction of solenoid rod 105*b*. In each of the tapered portions, a gap between the outer peripheral surface of solenoid rod 105*b* and the inner circumferential surface of rod passage 7*a* is formed, so that the size of the gap increases toward the low-pressure side, rather than in the high-pressure side, over at least a portion of solenoid rod 105*b* in its radial direction.

Similarly, pressure sensitive rod 104 is a tapered form so as to gradually decrease in its diameter from a high-pressure side (e.g., a crank chamber pressure side) toward a low-pressure side (e.g., the side of pressure sensing chamber 15) in the radial direction of pressure sensitive rod 104. A gap between the outer peripheral surface of pressure sensitive rod 104 and the inner circumferential surface of rod passage 1*c* is formed, so that the gap may increase in size in the direction of the low-pressure side, rather than the high-pressure side, in the radial direction of the rod. The difference between the larger diameter side and the smaller diameter side of each of rods 105*b* and 104 may be set, for example, in a range of about several microns to several tens of microns.

Thus, because the gap toward the low-pressure side is set larger than the gap of the high-pressure side, even in a situation in which the axis of rod 105*b* or 104 is shifted relative to the axis of rod passage 7*a* or 1*c*, respectively, the gap is prevented or limited from becoming smaller from the high-pressure side toward the low-pressure side, and foreign materials having entered into the gap may be readily discharged from the gap with the refrigerant flow. Further, even if the foreign materials are not discharged, the rod does not become wedged in the rod passage when the foreign materials are moved from the high-pressure side toward the low-pressure side, and the foreign materials do not damage the movement of the rod by being nipped on the way. Therefore, smooth operations of solenoid rod 105*b* and pressure sensitive rod 104 may be stably maintained.

The gap forming structure in solenoid rod 105*b* may be formed as a single rod similar to that described for pressure sensitive rod 104. Further, the gap forming structure in pressure sensitive rod 104 may be formed as a plurality of rods, similar to that in solenoid rod 105*b*. Further, the diameter of rod 105*b* or 104 may change in order to define a desirable gap. Nevertheless, in the above-described embodiment, instead of this structure, the inner diameter of rod passage 7*a* or 1*c* may be changed to obtain substantially the same advantage. Thus, both the diameter of the rod and the inner diameter of the rod passage may be changed.

Figure 2:
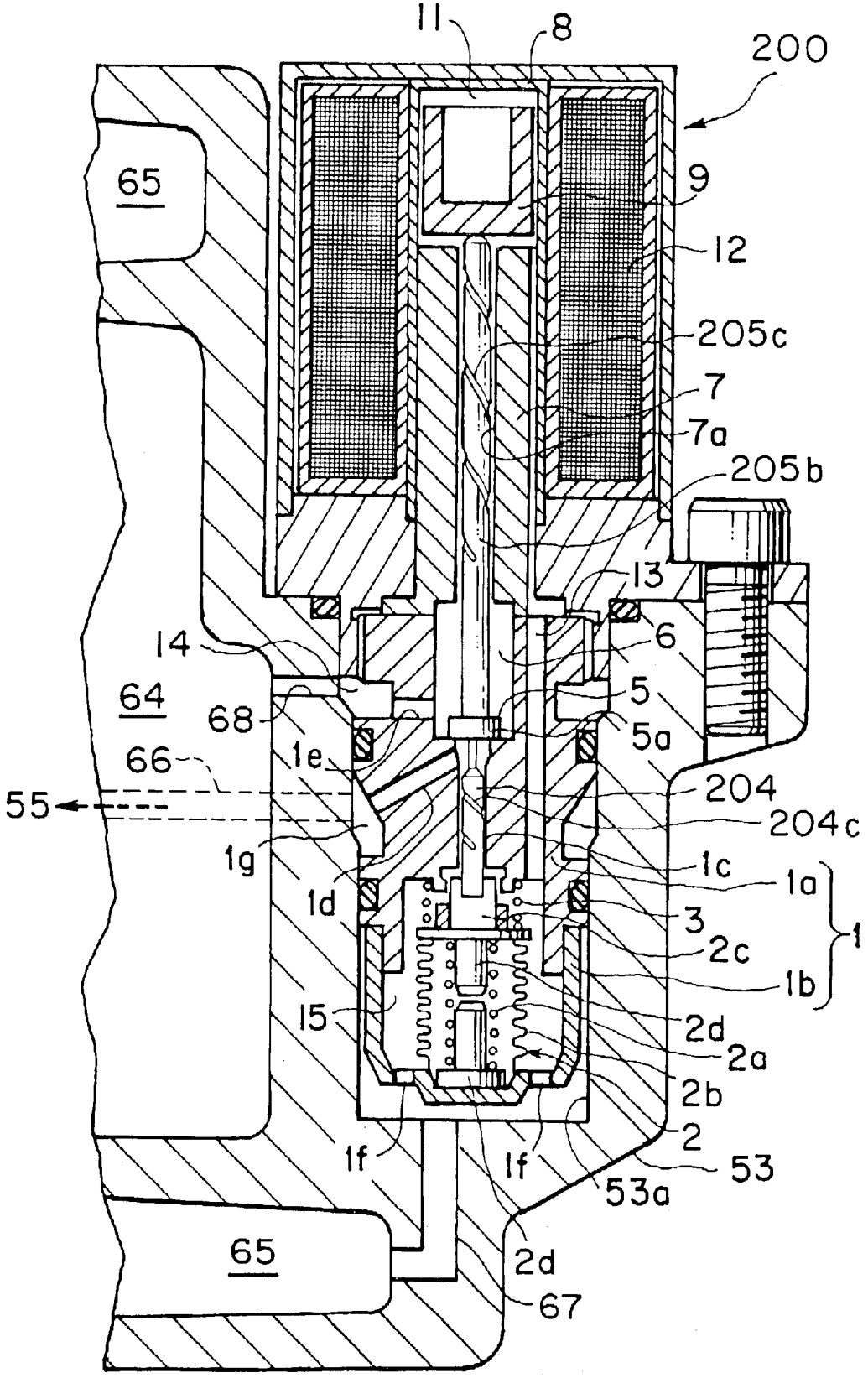
FIG. 2 is a cross-sectional view of a displacement control valve of a variable displacement compressor according to another embodiment of the present invention.
Figure 4:
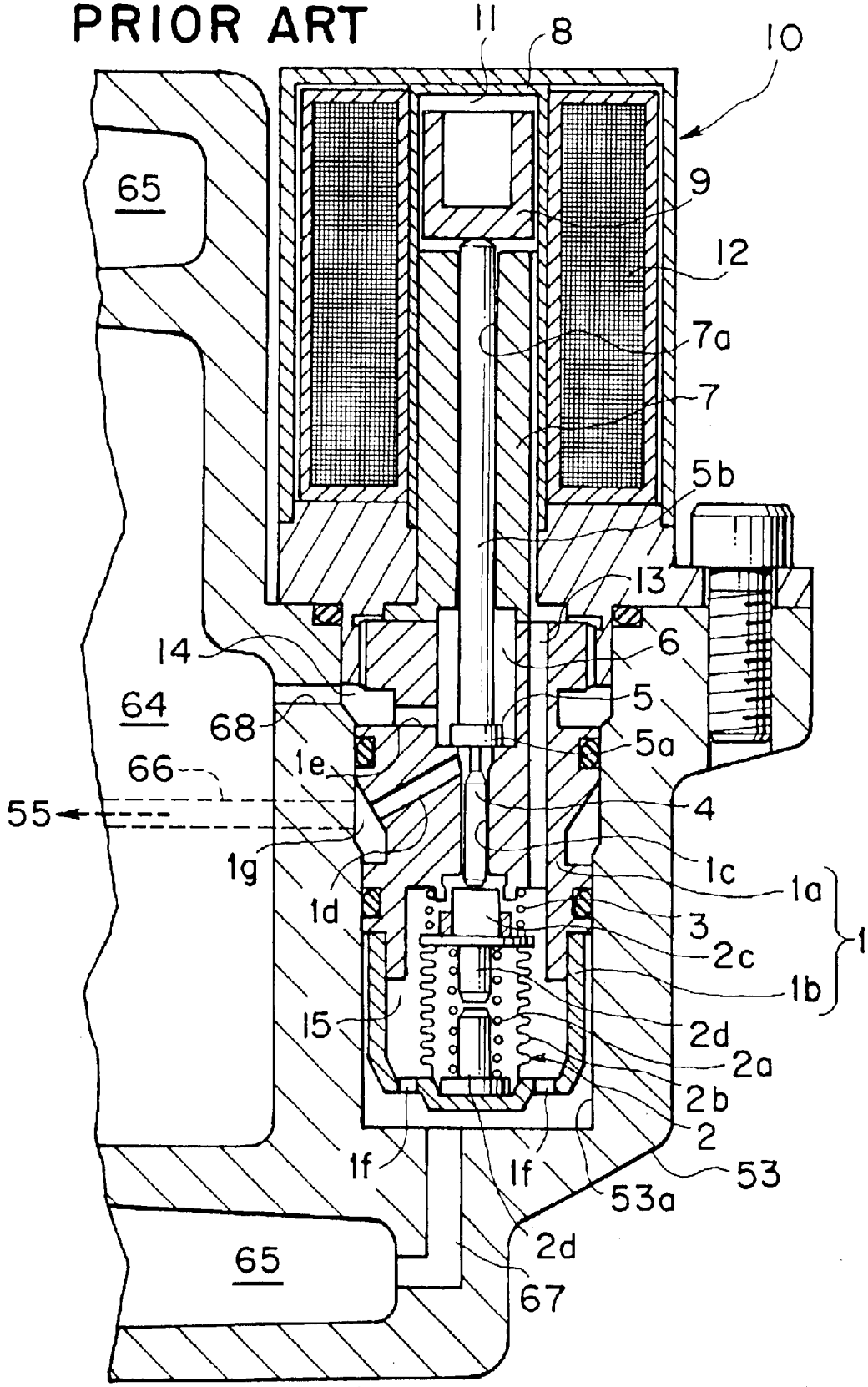
FIG. 4 PRIOR ART
FIG. 4 is a cross-sectional view of a displacement control valve of the variable displacement compressor depicted in FIG. 3.
Figure 5:
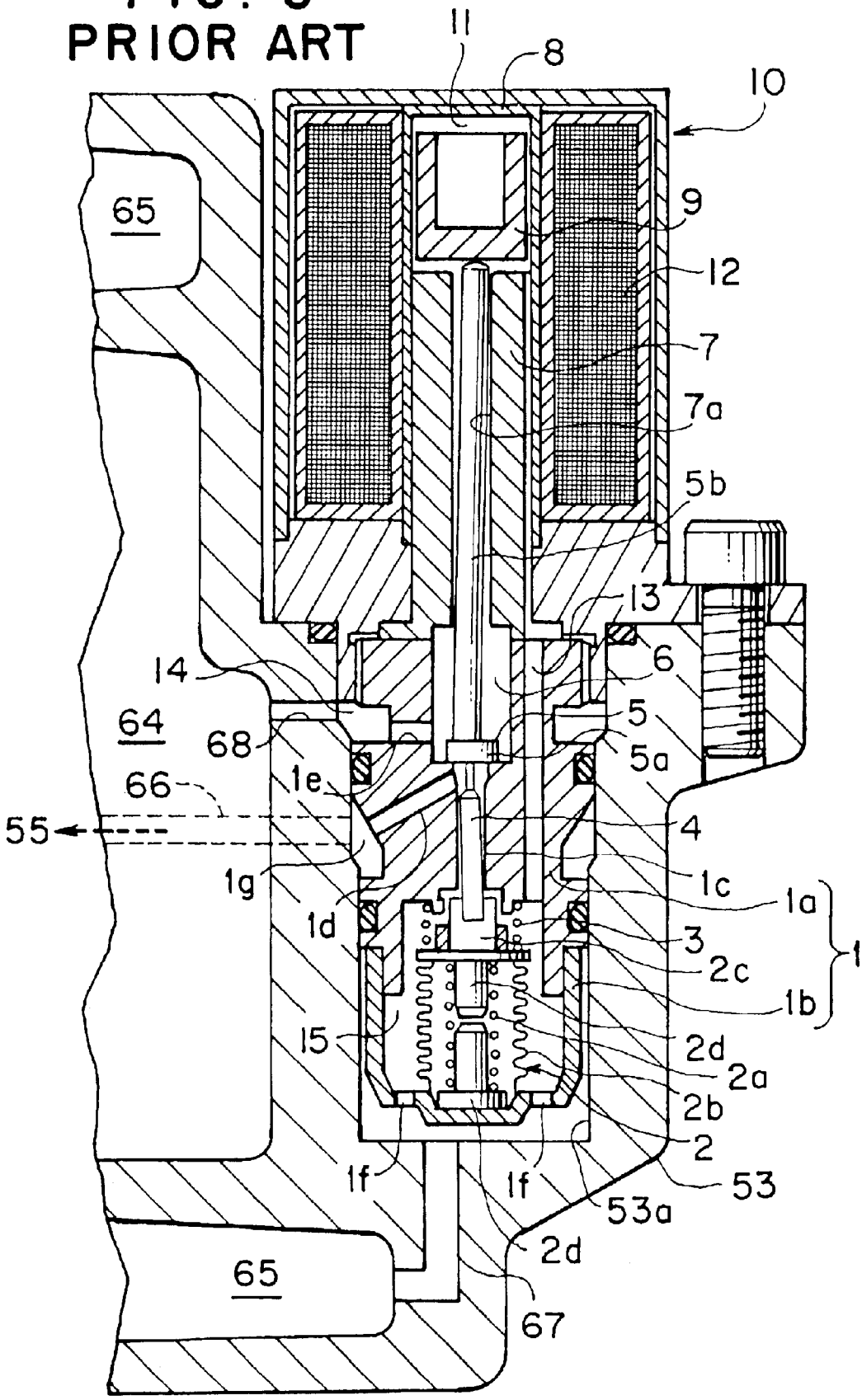
FIG. 5 PRIOR ART
FIG. 5 is a cross-sectional view of the displacement control valve depicted in FIG. 4, showing a problem therein.

FIG. 2 depicts a displacement control valve of a variable displacement compressor according to another embodiment of the present invention. Again, as compared with the structure depicted in FIGS. 4 and 5, the structures of a solenoid rod 205*b* and a pressure sensitive rod 204 of a displacement control valve 200 are different from those discussed above and are described herein in detail. Because the structures of other portions are substantially the same as those depicted in FIGS. 4 and 5, explanation for the other portions is omitted here and the same labels as those in FIGS. 4 and 5 are given to corresponding elements.

In FIG. 2, a spiral groove 205*c* extends in the radial direction of solenoid rod 205*b* is provided on the outer peripheral surface of solenoid rod 205*b* inserted into rod passage 7*a* of fixed core 7. Further, a spiral groove 204*c* extending along the radial direction of pressure sensitive rod 204 is provided on the outer peripheral surface of pressure sensitive rod 204 inserted into rod passage 1*c*. These spiral grooves may be provided on the inner circumferential surfaces of rod passage 7*a* and 1*c*, and may be provided on both the outer peripheral surfaces of solenoid rod 205*b* and those of pressure sensitive rod 204 and the inner circumferential surfaces of rod passages 7*a* and 1*c*. Further, a plurality of spiral grooves may be provided substantially in parallel to each other.

By providing such a spiral groove, fine foreign materials which may enter into the gap from the high-pressure side may be captured in the spiral groove at an appropriate position, and the foreign materials may be discharged accompanying with the refrigerant flowing in and along the spiral groove. Even if the foreign materials are not discharged, the rod may not wedge within the passage, and therefore, smooth operations of solenoid rod 205*b* and pressure sensitive rod 204 may be stably maintained.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A displacement control valve for use in a variable displacement compressor, wherein the displacement of said compressor is varied by closing or opening a control path between a discharge chamber or a suction chamber and a crank chamber, said valve comprising:

a valve body for closing or opening said control path;

a control rod; and a rod passage receiving said control rod, wherein a first end of said control rod is affixed to said valve body and said control rod extends from said valve body to means for urging said valve body to close or open said control path, wherein said control rod is tapered, such that a first cross-sectional area of said control rod proximate to said valve body is greater than a second cross-sectional area of said control rod proximate to said means for urging said valve body to close or open said control path.

2. The displacement control valve of claim 1, wherein said rod comprises a pair of opposing control rods, each affixed to opposing faces of said valve body; wherein a gap is formed between at least one of said opposing rods and said rod passage in which said at least one of said opposing rods is received, and wherein said gap increases in size proximate to said means for urging said valve body.

3. The displacement control valve of claim 1, wherein said control rod comprises a plurality of rod segments and each of said rod segments is tapered; wherein a gap is formed between said rod and said rod passage; and wherein said gap increases in size proximate to said means for urging said valve body.

4. The displacement control valve of claim 1, wherein said means for urging said valve body comprises a solenoid and a plunger disposed within a plunger chamber, wherein said solenoid urges said plunger along said plunger chamber and said rod comprises a solenoid rod operatively connecting said plunger and said valve body.

5. The displacement control valve of claim 1, wherein said means for urging said valve body comprises a first pressure sensor, wherein said first pressure sensor comprises a pressure sensing chamber alternatively connected to said suction chamber or said crank chamber via a pressure detection path, and wherein a second pressure sensor is disposed in said pressure sensing chamber, and said rod comprises a pressure sensitive rod operatively connecting said pressure sensing means and said valve body.

6. The displacement control valve of claim 1, wherein said means for urging said valve body comprises a solenoid and a plunger disposed within a plunger chamber, wherein said solenoid urges said plunger along said plunger chamber and said rod comprises a solenoid rod operatively connecting said plunger and said valve body, and wherein said means for urging said valve body comprises a first pressure sensor, wherein said first pressure sensor comprises a pressure sensing chamber alternatively connected to said suction chamber or said crank chamber via a pressure detection path, and wherein a second pressure sensor is disposed in said pressure sensing chamber, and said rod comprises a pressure sensitive rod operatively connecting said pressure sensing means and said valve body.

7. A variable displacement compressor comprising a displacement control valve, wherein the displacement of said compressor is varied by closing or opening a control path between a discharge chamber or a suction chamber and a crank chamber, said valve comprising:

a valve body for closing or opening said control path;

a control rod; and a rod passage receiving said control rod, wherein a first end of said control rod is affixed to said valve body and said control rod extends from said valve body to means for urging said valve body to close or open said control path, wherein said control rod is tapered, such that a first cross-sectional area of said control rod proximate to said valve body is greater than a second cross-sectional area of said control rod proximate to said means for urging said valve body to close or open said control path.

8. A displacement control valve for use in a variable displacement compressor, wherein the displacement of said compressor is varied by closing or opening a control path between a discharge chamber or a suction chamber and a crank chamber, said valve comprising:

a valve body for closing or opening said control path;

a control rod; and a rod passage receiving said control rod, wherein a first end of said control rod is affixed to said valve body and said control rod extends from said valve body to means for urging said valve body to close or open said control path, wherein said rod is tapered, such that a gap formed between said rod and said rod passage increases in size proximate to said means for urging said valve body.

9. The displacement control valve of claim 8, wherein said rod comprises a pair of opposing control rods, each affixed to opposing faces of said valve body; wherein said gap is formed between at least one of said opposing rods and said rod passage in which said at least one of said opposing rods is received, and wherein a first cross-sectional area of said at least one of said opposing rods proximate to said valve body is greater than a second cross-sectional area of said at least one of said opposing rods proximate to said means for urging said valve body to close or open said control path.

10. The displacement control valve of claim 8, wherein said control rod comprises a plurality of rod segments and each of said rod segments is tapered; and wherein a first cross-sectional area of said control rod proximate to said valve body is greater than a second cross-sectional area of said control rod proximate to said means for urging said valve body to close or open said control path.

11. The displacement control valve of claim 8, wherein said means for urging said valve body comprises a solenoid and a plunger disposed within a plunger chamber, wherein said solenoid urges said plunger along said plunger chamber and said rod comprises a solenoid rod operatively connecting said plunger and said valve body.

12. The displacement control valve of claim 8, wherein said means for urging said valve body comprises a first pressure sensor, wherein said first pressure sensor comprises a pressure sensing chamber alternatively connected to said suction chamber or said crank chamber via a pressure detection path, and wherein a second pressure sensor is disposed in said pressure sensing chamber, and said rod comprises a pressure sensitive rod operatively connecting said pressure sensing means and said valve body.

13. The displacement control valve of claim 8, wherein said means for urging said valve body comprises a solenoid and a plunger disposed within a plunger chamber, wherein said solenoid urges said plunger along said plunger chamber and said rod comprises a solenoid rod operatively connecting said plunger and said valve body, and wherein said means for urging said valve body comprises a first pressure sensor, wherein said first pressure sensor comprises a pressure sensing chamber alternatively connected to said suction chamber or said crank chamber via a pressure detection path, and wherein a second pressure sensor is disposed in said pressure sensing chamber, and said rod comprises a pressure sensitive rod operatively connecting said pressure sensing means and said valve body.

14. A variable displacement compressor comprising a displacement control valve, wherein the displacement of said compressor is varied by closing or opening a control path between a discharge chamber or a suction chamber and a crank chamber, said valve comprising:

a valve body for closing or opening said control path;

a control rod; and a rod passage receiving said control rod, wherein a first end of said control rod is affixed to said valve body and said control rod extends from said valve body to means for urging said valve body to close or open said control path, wherein said rod is tapered, such that a gap formed between said rod and said rod passage increases in size proximate to said means for urging said valve body.

15. A displacement control valve for use in a variable displacement compressor, wherein the displacement of said compressor is varied by closing or opening a control path between a discharge chamber or a suction chamber and a crank chamber, said valve comprising:

a valve body for closing or opening said control path;

a control rod; and a rod passage receiving said control rod, wherein a first end of said control rod is affixed to said valve body and said control rod extends from said valve body to means for urging said valve body to close or open said control path, wherein a spiral groove is formed about, within, and over at least a portion of a peripheral surface of at least one of said rod and of said rod passage.

16. The displacement control valve of claim 15, wherein said spiral groove comprises a plurality of substantially parallel, spiral grooves.

17. The displacement control valve of claim 15, wherein said means for urging said valve body comprises a solenoid and a plunger disposed within a plunger chamber, wherein said solenoid urges said plunger along said plunger chamber and said rod comprises a solenoid rod operatively connecting said plunger and said valve body.

18. The displacement control valve of claim 15, wherein said means for urging said valve body comprises a first pressure sensor, wherein said first pressure sensor comprises a pressure sensing chamber alternatively connected to said suction chamber or said crank chamber via a pressure detection path, and wherein a second pressure sensor is disposed in said pressure sensing chamber, and said rod comprises a pressure sensitive rod operatively connecting said pressure sensing means and said valve body.

19. The displacement control valve of claim 15, wherein said means for urging said valve body comprises a solenoid and a plunger disposed within a plunger chamber, wherein said solenoid urges said plunger along said plunger chamber and said rod comprises at least one solenoid rod operatively connecting said plunger and said valve body, and wherein said means for urging said valve body comprises a first pressure sensor, wherein said first pressure sensor comprises a pressure sensing chamber alternatively connected to said suction chamber or said crank chamber via a pressure detection path, and wherein a second pressure sensor is disposed in said pressure sensing chamber, and said rod comprises a pressure sensitive rod operatively connecting said pressure sensing means and said valve body.

20. A variable displacement compressor comprising a displacement control valve, wherein the displacement of said compressor is varied by closing or opening a control path between a discharge chamber or a suction chamber and a crank chamber, said valve comprising:

a valve body for closing or opening said control path;

a control rod; and a rod passage receiving said control rod, wherein a first end of said control rod is affixed to said valve body and said control rod extends from said valve body to means for urging said valve body to close or open said control path, wherein a spiral groove is formed about, within, and over at least a portion of a peripheral surface of at least one of said rod and of said rod passage.

21. A variable displacement compressor comprising a displacement control valve, wherein the displacement of said compressor is varied by closing or opening a control path between a discharge chamber or a suction chamber and a crank chamber, said valve comprising:

a valve body for closing or opening said control path;

a control rod; and a rod passage receiving said control rod, wherein a first end of said control rod is affixed to said valve body and said control rod extends from said valve body to means for urging said valve body to close or open said control path, wherein a spiral groove is formed about, within, and over at least a portion of a peripheral surface of said rod.

22. A method for manufacturing a variable displacement compressor, comprising the steps of:

providing a displacement control valve, wherein said valve comprises a valve body for closing or opening a control path, a control rod, a rod passage receiving said control rod, wherein a first end of said control rod is affixed to said valve body and said control rod extends from said valve body to means for urging said valve body to close or open said control path; and tapering said control rod, such that a first cross-sectional area of said control rod proximate to said valve body is greater than a second cross-sectional area of said control rod proximate to said means for urging said valve body to close or open said control path.

23. A method for manufacturing a variable displacement compressor, comprising the steps of:

providing a displacement control valve, wherein said valve comprises a valve body for closing or opening a control path, a control rod, a rod passage receiving said control rod, wherein a first end of said control rod is affixed to said valve body and said control rod extends from said valve body to means for urging said valve body to close or open said control path; and tapering said control rod, such that a gap formed between said rod and said rod passage increases in size proximate to said means for urging said valve body.

24. A method for manufacturing a variable displacement compressor, comprising the steps of:

providing a displacement control valve, wherein said valve comprises a valve body for closing or opening a control path, a control rod, a rod passage receiving said control rod, wherein a first end of said control rod is affixed to said valve body and said control rod extends from said valve body to means for urging said valve body to close or open said control path; and forming a spiral groove is formed about, within, and over at least a portion of a peripheral surface of at least one of said rod and of said rod passage.

* * * * *